United States Patent [19]

Williams

[11] Patent Number: 5,012,757

[45] Date of Patent: May 7, 1991

[54] AUTOMATIC HORN WARNING SIGNAL APPARATUS FOR USE ON BOATS

[76] Inventor: James E. Williams, 542 Stillwater Rd., Stamford, Conn. 06902

[21] Appl. No.: 511,639

[22] Filed: Apr. 20, 1990

[51] Int. Cl.[5] ..... G08B 3/02; B63B 45/08

[52] U.S. Cl. ..... 116/19; 116/18

[58] Field of Search ..... 116/18, 19, 24, 26; 340/984, 985

[56] References Cited

U.S. PATENT DOCUMENTS

| | | | |
|---|---|---|---|
| 347,319 | 8/1886 | Brown | 116/137 R |
| 486,008 | 11/1892 | Williams | 116/19 |
| 1,018,506 | 2/1912 | Lane | 116/19 |
| 1,904,534 | 4/1933 | Rice | 116/19 |
| 1,973,673 | 9/1934 | Rice | 116/19 |

FOREIGN PATENT DOCUMENTS

| | | | |
|---|---|---|---|
| 1060749 | 7/1956 | Fed. Rep. of Germany | 116/18 |

*Primary Examiner*—Thomas B. Will
*Assistant Examiner*—W. Morris Worth
*Attorney, Agent, or Firm*—Permelee, Bollinger & Bramblett

[57] ABSTRACT

Automatic horn warning signal apparatus for use on boats is compact, unitary, self-contained, lightweight, drycell-battery-energized, is manually selectably actuated for automatically sounding any of nine predetermined patterns of warning horn signal sequences applicable to specified, recognized navigational procedures for marine craft. A small motor operates through a first speed-reducing, torque-increasing transmission for rotating a main cam shaft containing nine lobed cams each having a different configuration corresponding to the desired warning signal pattern to be sounded. A control lever is engageable with any of the nine cams for selecting the desired automatically sounded horn signal sequence. A second speed-reducing, torque-increasing transmission rotates a latching cam shaft at one-tenth the rate of the main cam shaft for operating a latch for enabling a pivot bar to serve as fulcrum for the control lever. For causing the control lever to actuate a valve for releasing pulses of compressed gas into the horn for sounding the selected warning signal sequence determined by a particular cam. The signal pattern is sounded only once during each revolution of the latching cam. When any of four signal sequences has been selected, pressing a start button causes repeated sounding of the selected signal sequence. Selecting the other five warning sequences opens the repeat switch, causing only one sounding of the signal sequence after pressing the start button. Manually depressing the horn immediately sounds a continuous blast as long as depressed.

22 Claims, 2 Drawing Sheets

AUTOMATIC HORN WARNING SIGNAL APPARATUS FOR USE ON BOATS

FIELD OF THE INVENTION

The present invention is in the field of automatically producing sequences of warning horn signals, and more particularly relates to a compact, unitary, manually-presettable, self-contained, lightweight, drycell-battery-energized and mechanically operable horn sounder advantageous for use on non-commercial, owner-operated motorboats and sailboats.

BACKGROUND

There are expensive, electronic-type, complex, automatic controllers for producing various predetermined patterns of horn warning signal sequences for use on motorboats and sailboats. Such patterns of warning horn signal sequences are applicable to specified, recognized navigational procedures or protocol relating to such marine craft. Thus, a boat owner can purchase and install an electronic-type of automatic signal horn sounder. However, the damp, bad-weather conditions encountered in relatively small non-commercial boats can cause such electronic gear to become undependable in operation when most needed. Moreover, such installed electronic gear usually remains on the boat for an entire season, where it is subject to deterioration from dampness, salt spray, cyclic night-to-day temperature changes and from repeated mechanical stresses caused by wave-induced rocking and surf pounding of the moored boat.

An automatic signal horn sounder is used in a fog or at night for sending out repetitive sequences of horn signals for alerting and warning the operators of other unseen marine craft in the vicinity. It is possible for a boat operator manually to sound sequences of horn signals by actuating the trigger on a compressed-gas-operated horn. But manually sending out repetitive warning signals is boring, tiring and subject to inadvertent error or ambiguous variations due to lapses or irregularities in a sequence as caused by inattention or distraction of the operator resulting from emergency or fatigue.

When entering into or maneuvering in a busy marine channel or crowded harbor, an automatic signal horn sounder is particularly useful and helpful for a boat operator who is often very busy steering and attentive to other boats and hazards. Moreover, at a critical juncture in a perceived emergency, a non-commercial boat operator may forget or momentarily become unsure of the specific sequence of horn signals called for by marine protocol under the particular conditions at hand. Thus, automatic horn-sounder equipment is very welcome at such times.

The present invention solves or substantially overcome such problems occurring with prior automatic horn sounder signal equipment now available for use on motorboats and sailboats.

SUMMARY

The present automatic horn signal sounder apparatus comprises a compact, lightweight, portable, drycell-battery-energized unit which a non-commerical boat owner can readily carry home when coming ashore. This compact unit is located between (1) a commercially available, inexpensive horn, and (2) a commercially available, inexpensive can of compressed gas containing a plunger operable valve for releasing a fast flow of compressed gas into the horn for producing a loud blast of sound.

The unit's operating mechanism is mechanical in nature for rendering it ruggedly dependable in operation in damp, bad-weather conditions encountered in boats on the water. Moreover, by virtue of its relatively inexpensive compact, lightweight, portable design, a boat owner can readily keep the unit at home where it can advantageously be tested (in a closed room or in a basement so as to avoid disturbing neighbors) before setting out to take the boat for a trip. Since this unit is relatively inexpensive, the boat owner can have another one at home for use in the unlikely event that the first malfunctions during a pre-test at home. Thus, the boat owner can set out from home carrying the pre-tested unit and thus knowing full well that a fully functional automatic horn signal sounder will be available on board.

Electronic gear installed on a boat must be tested on the boat, which is an awkward and inconvenient site for testing. Furthermore, if the boat owner has come on board early on a Saturday morning with family members or friends looking forward to a pleasurable weekend on the water, the boat owner may decide to cast off from the mooring and head out of the harbor, regardless of malfunctioning of such electronic equipment. The lure of an enjoyable weekend and desire not to disappoint other crew members overcomes the need to arrange for immediate repair or service for the malfunctioning electronic gear.

The present compact unit is of mechanical design having operating-mode-selector control means manually settable for selecting any one of nine operating modes for automatically sounding out any one of nine predetermined patterns of horn signal sequences applicable to specified navigational situations as called for by marine protocol whenever a start button is pushed. Four of these operating positions involve closure of a repeat switch for automatically continuously repeating horn signals, so long as the selector control remains selecting any one of these four operating modes. These four repeated audible signal sequences convey the following respective messages: (1) underway, (2) underway but stopped, (3) fishing or sailing, (4) in tow.

Five of these operating mode selections provide a signal pattern which is sounded once as a result of each actuation of the start button. These five audible signal patterns convey the following respective messages: (5) going starboard, (6) going port, (7) going astern, (8) danger, (9) entering channel.

A small, drycell-battery-energized motor drives through a first speed-reducing, torque-increasing gear set for rotating a main cam shaft at a relatively slow rate of rotation. This main cam shaft carries nine lobed cams each having a different configuration corresponding to the selected desired sound signal pattern automatically to be provided. A control lever is brought into engagement with any one of the nine cams for selecting the desired horn signal pattern to be sounded automatically. This control lever requires cooperative action of a fulcrum for causing this control lever to actuate a valve for releasing compressed gas into a horn for sounding the desired warning signal sequence in response to rotation of the selected lobed cam. In the absence of the needed fulcrum, the control lever will ride over the "high" sectors of the lobed cam without actuating the gas-release valve, and consequently the horn will not be sounded.

The fulcrum for providing operation of the control lever is carried by a latchable pivot bar. When this pivot bar is latched in fixed position, the control lever is provided with its fulcrum, and thus this control lever in riding over the high sectors of the cam serves to actuate a gas-release valve assembly for sounding the horn.

There is a second speed-reducing, torque-increasing gear set which causes a latching cam shaft to rotate at a rate considerably slower than the main cam shaft for latching and unlatching the fulcrum-carrying pivot bar discussed above for thereby providing a predetermined duration of time pause intervening between each signal pattern.

The valve assembly and horn are arranged with the horn located above the automatic sounder unit. Thus, the horn is fully exposed and is available to be manually depressed at any time as needed. Such manual depression of the horn will immediately sound a continuous blast as long as the horn is being depressed, regardless of whether or not an automatic signal sequence is in progress. In other words, manual override of the automatic control is always readily and conveniently available at any moment.

BRIEF DESCRIPTION OF THE DRAWINGS

The invention, together with further objects, features, aspects and advantages thereof will be more fully understood and appreciated by consideration of the following description in conjunction with the accompanying drawings in which the respective elements bear the same reference numerals throughout the various views. The drawings are not drawn to scale but instead are arranged for clarity of illustration.

DETAILED DESCRIPTION OF PREFERRED EMBODIMENT

Figure 1:
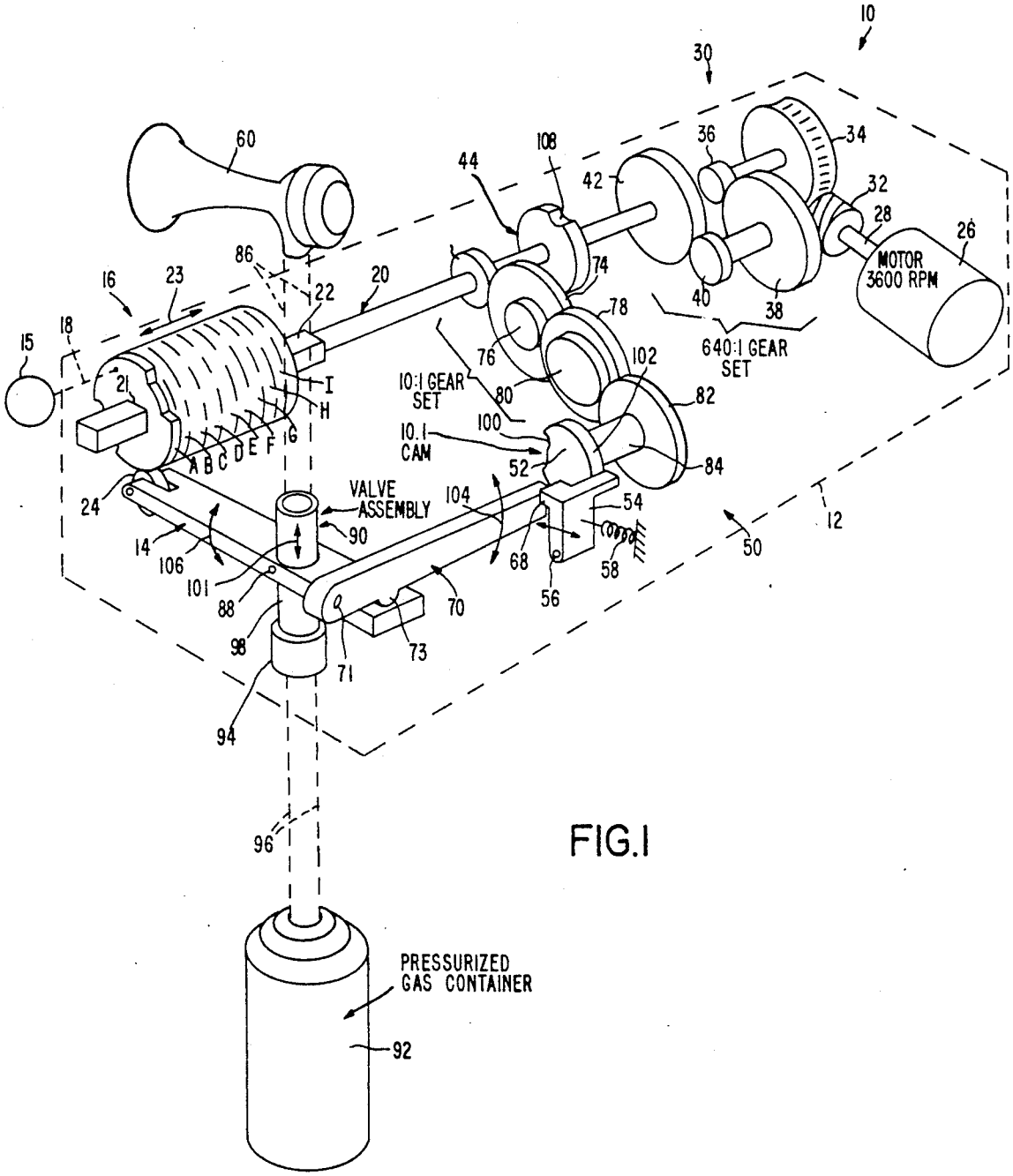
FIG. 1 is a perspective view illustrating the arrangement of the mechanical components of an automatic horn sounding warning signal apparatus embodying the present invention for use on boats.

As shown in the drawings, the present compact automatic horn sounding warning signal apparatus 10 for use on boats is lightweight and is contained in a relatively small housing 12 shown in FIG. 1 in dashed outline. An operating-mode-control lever 14 (FIG. 1) is manually brought into engagement with any one of nine selectable cams in a cam set 16. Manually actuatable mode-selector control means 15, for example, such as a nine-position rotatable control knob, or nine push buttons, or a nine-position slide bar, are operatively associated with the cam set 16, as shown by the dashed mechanical connection line 18. The mode-selector control means 15 are accessible outside of the housing 12 in a convenient location for easy actuation by an operator, such as the helmsman, a crew member, or a passenger.

This cam set 16 comprises the nine lobed cams A through I coaxially mounted side-by-side on a main cam shaft 20. The cam set is axially slidable along this main shaft 20 but is keyed to this shaft in positive rotary drive relationship for rotating the cam set by rotation of the main shaft. For example, this positive drive keying is provided by a rectangular (or square) central hole 21 in each cam engaging a rectangular or square section 22 of the main shaft 20. Thus, the operator manually actuates the mode selector means 15 for shifting the cam set 16 along the keyed shaft section 22, as shown by the double-headed arrow 23, into any one of nine selected positions for bringing a cam-follower roller 24 rotatably mounted on the end of the lever 14 into rolling engagement with any one of the nine lobed cams A, B, C, D, E, F, G, H and I (FIG. 2) for selecting any desired one of the horn-sounding signal sequences to be automatically provided.

Figure 2:
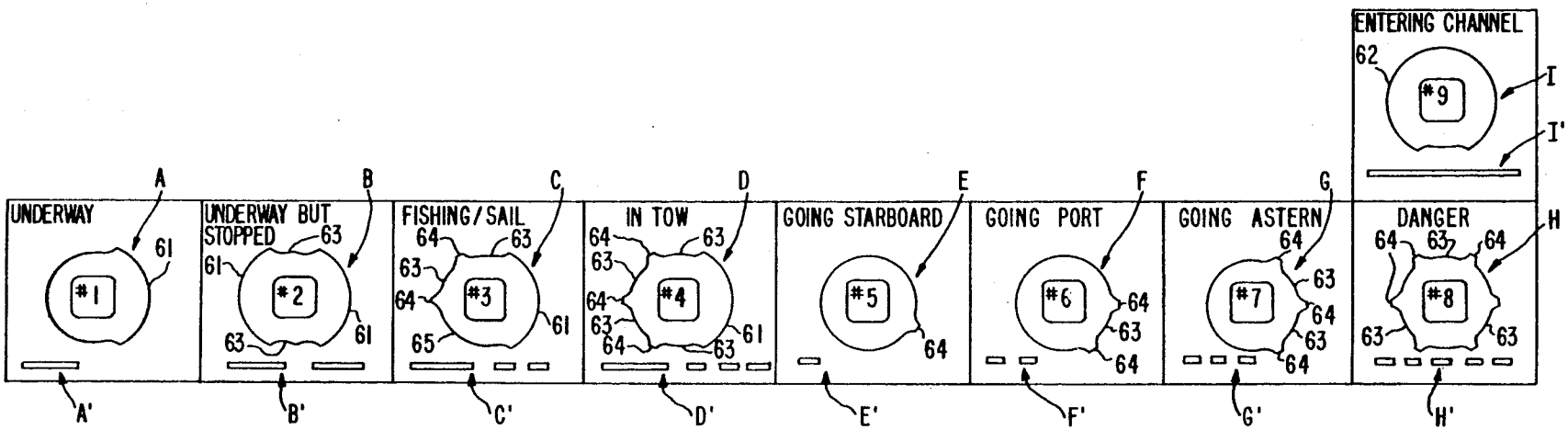
FIG. 2 shows shows the nine different configurations of the lobed cams which are mounted side-by-side on a main cam shaft in the apparatus of FIG. 1, and FIG. 2 also shows the respective nine horn-sounding sequences automatically provided by setting a control lever into engagement with any one of the cams for pre-selecting the desired horn-sounding signal pattern.

The various configurations of these nine lobed cams are shown in FIG. 2. Also shown in FIG. 2 are the respective horn-sounding warning sequences A', B', C', D', E', F', G', H' and I' produced by these respective cams and having the respective meanings as set forth below:

| Signal Sequences: | Meaning: |
|---|---|
| A' | UNDERWAY |
| B' | UNDERWAY BUT STOPPED |
| C' | FISHING/SAILING |
| D' | IN TOW |
| E' | GOING STARBOARD |
| F' | GOING PORT |
| G' | GOING ASTERN |
| H' | DANGER |
| I' | ENTERING CHANNEL |

Signal sequence A' comprises one medium-long sound blast on the horn 60 (FIG. 1). To produce this medium-long sounding of the horn 60, as will be explained later, the cam A has one medium-long lobe 61 extending about 120 degrees of a complete circle, i.e. extending circumferentially about 120 degrees around the axis of cam A. In contrast, signal sequence I' is one degree full-long sound blast produced by a full-long extending about 300 degrees of a complete circle, i.e. extending circumferentially about 300 degrees around the axis of cam I.

Signal sequence B' comprises two medium-long sound blasts in relatively quick succession. Thus, the cam B has two medium-long lobes 61, each extending circumferentially about 120 degrees separated by a medium-length depression 63 extending angularly for about 60 degrees. There is another medium-length depression 63 of about 60 degrees angular extent for completing one whole rotation of the cam B.

Signal sequence C' Comprises one medium-long sound blast followed by two short sound blasts in relatively quick succession. Thus, cam C includes one medium-long lobe 61 of about 120 degrees angular extent plus two short cam lobes 64 each of about 15 degrees angular extent, with two medium-length depressions 63 each of about 60 degrees angular extent. Then, there is a final depression 65 of about 90 degrees angular extent for completing one revolution of this cam C.

Signal sequence D' comprises one medium-long sound blast followed by three short sound blasts in relatively quick succession. Consequently, the cam D includes one medium-long cam 61 of about 120 degrees angular extent and three short cam lobes 64 each of about 13 degrees angular extent and four medium length depressions 63 each of about 50 degrees angular extent.

Signal sequence R' is one short sound blast, and the cam E includes only one short cam lobe 64 of about 15 degrees angular extent. The signal sequence F' includes two short sound blasts in relatively quick succession, and cam F includes two short cam lobes 64 each of about 15 degrees angular extent straddling a depression 63 of about 60 degrees angular extent. The signal sequence G' comprises three short sound blasts in relatively quick succession, and the cam G includes three short cam lobes each of about 15 degrees angular extent alternating with two depressions 63 each of about 60 degrees angular extent.

The danger signal sequence H' includes at least five short sound blasts in rapid succession, and so the cam H includes at least five short cam lobes 64 each of about 15 degrees angular extent alternating with intervening depressions 63. Marine horn signalling protocol requires at least five short horn blasts in reasonably rapid succession as a danger warning signal as shown at H'. The six-lobed cam H actually provides six such short blasts of the horn 60, and so it meets the protocol requirement.

In order to rotate the main cam shaft 20, there is a small drycell-battery energizable electric motor 26, for example, rotating at about 3,600 revolutions per minute (RPM), whose drive shaft 28 is connected with a speed-reducing, torque-increasing transmission generally indicated at 30, for example, a gear set providing a speed reduction of about 640 to 1, thus turning the main cam shaft 20 at a rate of about 5.6 RPM. It is preferred to have this main cam shaft rotate at a speed in the preferred range from about 2 RPM to about 10 RPM and in the most preferred range from about 4 RPM to about 7 RPM. A suitable transmission comprises a worm gear 32 affixed to the motor shaft 28 driving a worm wheel 34 whose shaft drives a small diameter spur gear 36 engaging a large diameter spur gear 38 whose shaft drives a second small diameter spur gear 40 engaging a second large diameter spur gear 42 affixed to the main cam shaft 20 for turning this main shaft.

Fastened to the main shaft 20 near the drive gear 42 is a one-revolution cam 44 which serves to control a one-revolution switch to be described later regarding FIG.3. The purpose of this one-revolution cam and its controlled switch will be explained later.

When any one of the first four above signal sequences has been selected by manually setting the mode-selector control 15, then a repeat switch 46 (FIG. 3) becomes closed. Consequently, this repeat switch 46 automatically causes the signal sequence A', B', C' or D' to be repeated until the mode-selector control 15 is moved away from selection of any of the first four signal sequences.

In order to cause any selected one of the first four signal sequences A', B', C' or D' to be repeated with an appropriate time span between each such repetition, there is a second speed-reducing, torque-increasing transmission generally indicated at 50, which drives a latching cam 52 for controlling a latch 54 pivotally mounted at 56. A spring 58 urges this latch 54 toward its controlling cam 52. The latch 54 includes a detent 68 engageable upon a fulcrum bar 70 pivotally mounted at 71 and having a fulcrum protrusion 73, whose function will be explained later.

The transmission 50 includes a small diameter spur gear 72 fixed on the main shaft 20 near the one-revolution cam 44 and engaging with a large diameter spur gear 74 coaxial with another small diameter spur gear 76 in driving engagement with a large diameter spur gear 78. Next, there is a medium-diameter spur gear 80 coaxial with gear 78 and engaging a large diameter spur gear 82 fixed on a latching cam shaft 84 for rotating the latching cam 52.

This transmission 50 rotates the latching cam shaft 84 at considerably reduced speed relative to the main cam shaft 20, for example, there is a 10 to 1 speed reduction. It is preferred to have this speed reduction of transmission 50 be in the range from about 6 to 1 to about 15 to 1. Thus, for example, with the main shaft 20 having a rotation rate of about 5.6 RPM, the latching cam shaft 84 turns at a rate of about 0.56 RPM, which causes the latching cam 54 to have a repetition of its latching function occurring at time intervals in the range of about 1.7 to 1.8 minutes. Consequently, any one of the first four warning horn signal sequences A', B', C' or D' is automatically repeated (so long as the repeat switch 46 remains closed) once every time interval of about 1.7 to 1.8 minutes.

The operation and purpose of the fulcrum projection 73 on the pivoted fulcrum bar 70 will now be explained. When this fulcrum bar is restrained, i.e. when it is being held down by the detent 68 on the latch 54, then there is provided a stationary fulcrum 73 for the control lever 14 which has an intermediate region pivotally connected at 88 to a valve assembly 90 connected as shown by dashed-lines 86 to the horn 60. Thus, when there is a stationary fulcrum 73, the lever 14 is seen to constitute a "lever of the second class" (i) having the driving force (or "effort") supplied by lobes on the selected one of the cams in the cam set 16, such "effort" being applied through roller 24 at one end of the lever 14 and (ii) having a fulcrum 73 at the other end of lever 14 and (iii) having the "driven load", namely, the pivot connection 88 to valve assembly 90 located in an intermediate region of this lever 14. A conventional, commercially available container 92 of compressed gas for loudly blowing a boat horn 60 is removably screwed into a socket 94 at the lower end of the valve assembly 90, as indicated by the dashed-lines 96. The valve assembly 90 is opened for allowing compressed gas to rush from container 92 into horn 60 for sounding this horn by moving its sleeve 98 downwardly relative to the socket 94. Consequently, when a fulcrum 73 is provided by latching of the fulcrum bar 70, the lever 14 acts as a "lever of the second class", and it thus forces its pivot connection 88 and sleeve 98 downwardly, as shown by the double-headed arrow 101, for sounding the horn 60 during each time that the cam follower roller 24 is riding over any one of the cam lobes 61, 62 or 64. Thus, it is seen that the signal sequence being sounded is controlled by the lobe configuration on the selected one of cams A through I.

OPERATION

In the operation, the latching cam 52 has a depression 100 for allowing the spring 58 to move the latch 54 toward the fulcrum bar 70 for hooking the detent 68 over this fulcrum bar for providing a stationary fulcrum 73. This fulcrum-providing latching-action occurs only once during each rotation of cam 52 for causing a signal sequence to occur once during each rotation of the cam shaft 84.

Further describing operation, the latching cam 52 has a raised periphery or cam lobe 102 for pushing the latch 54 away from the fulcrum bar 70 for allowing this bar to swing freely up and down about its pivot 71 as indicated by a curved double-headed arrow 104. Thereby,the fulcrum 73 is released for freely moving up and down, and thus the control lever 14 is without any fulcrum and does not constitute a lever of the second class. The cam follower roller 24 rides over the cam lobes and moves the lever 14 up and down, as shown by the double-headed curved arrow 106, without producing any opening effect whatsoever on the normally-closed valve assembly 90.

Figure 3:
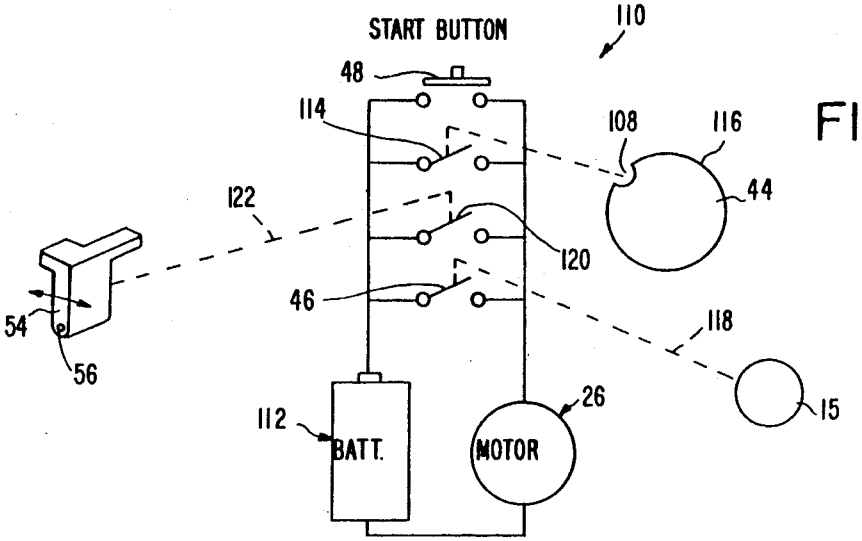
FIG. 3 shows the electric circuit of the apparatus of FIG. 1.

Continuing to describe operation, in FIG. 3 is shown a circuit diagram for the apparatus 10. This circuit 110 includes a drycell battery 112 in series with the motor 26 and with the start button switch 48 (normally open switch) such that brief manual closure of the start switch 48 cause the motor to begin rotation of the main cam shaft 20, thereby turning the completion-of-each-revolution cam 44 to move a switch-opening notch 108 away from a normally-open switch 114. This latter switch 114 is called the "one-complete-revolution switch" for reasons to be described later, and a raised periphery 116 on this completion-of-each revolution cam 44 holds this switch 114 closed until the main cam shaft 20 has completed exactly one whole revolution, thus returning to its initial, starting position. The cam 44 in FIG. 3 is shown in its initial, starting position, and consequently the one-complete-revolution switch 114 is allowed to be open a shown.

As shown by a dashed-line 118, the normally open repeat switch 46 is responsive to and becomes closed by manual action of the mode-selector-control 15 for selection of any one of the first four cams A, B, C or D. Consequently, any one of the first four signal sequences A', B', C' or D' is repetitively sounded once very about 1.7 to about 1.8 minutes, until the manual mode selector 15 is used to select a cam other than one of these first four cams.

The overall timing of the signal repetition at once every about 1.7 to about 1.8 minutes is produced by the latch-actuating cam 52 which rotates once for each ten rotations of the main shaft 20, as described above, acting as shown by dashed-line 122 in conjunction with a ten-for-one switch 120 responsive to outward displacement of the latch 54, as caused by the elevated peripheral region 102 of the latch-actuating cam 52. Consequently, after the motor 26 starts running by pressing the start switch 48, the latch 54 closes the normally-open switch 120 before the one-complete-revolution switch 114 has become released by the notch 108, and thus the notch 108 has no effect for nine rotations of the cam 44, because the switch 120 is being held closed by outward displacement of the latch on the latch-cam periphery 102. After nine revolutions have occurred of the main cam shaft 20, the latch 54 retracts into the latch cam depression 100, thus opening the switch 120. However, the one-complete-revolution cam 44 is holding the switch 114 closed until the tenth revolution of the main cam shaft has been exactly completed as determined by the notch 108 allowing the switch 114 to open.

Thus, it is seen that the switch 120 remains closed. Then the tenth time that the switch 114 is allowed to open, the switch 120 has already become open by retraction of the latch 54, and the motor 26 stops, because the circuit 110 has all of its switches open. The advantage of using this switch 114 is that the positioning of the notch 108 at an initial starting position is ten times more accurate than the positioning of the cam 52. In effect, the cam 44 and its controlled switch 114 act as a vernier for ten-times more accurately placing the main shaft at its initial starting position each cycle of operation.

Since other changes and modifications varied to fit particular operating requirements and environments will be recognized by those skilled in the art, the invention is not considered limited to the examples chosen for purposes of illustration, and includes all changes and modifications which do not constitute a departure from the true spirit and scope of this invention as claimed in the following claims and equivalents thereto.

I claim:

1. Horn signal apparatus for use on boats, said apparatus comprising:

a horn, valve means connected between said horn and a removable container of pressurized gas for preventing said valve means normally being closed for preventing pressurized gas from flowing from said container to said horn, said valve means being actuatable for allowing pressurized gas to flow from said container to said horn for sounding said horn, actuating means for actuating said valve means, said actuating means including a plurality of rotatable cams, each of said rotatable cams having a configuration corresponding to a respective horn-sounding signal sequence for actuating said valve means for allowing pressurized gas to flow to said horn for sounding said horn corresponding to the respective horn-sounding signal sequence, said respective horn-sounding signal sequences being different one from another for relating to predetermined respective boat situations in accord with marine horn-signalling protocol, electric motor drive means for driving said actuating means, electric circuit means connected to said electric motor drive means for controlling said electric motor drive means, said electric circuit means including switch means responsive to rotation of said plurality of cams for controlling energization of said electric motor drive means, speed-reducing, torque-increasing transmission means coupling said electric motor drive means to said plurality of cams for rotating said plurality of cams, and manually-operable, mode-selection means operatively associated with said plurality of cams for selecting any one of said cams for actuating said valve means in accordance with the configuration of said selected cam.

2. Horn signal apparatus for use on boats as recited in claim 1 wherein said actuating means further comprises: cam-follower valve actuator means associated with said valve means for actuating said valve means, and said manually-operable, mode-selection means bringing said cam-follower valve actuator means into engagement with a selected one of said cams for actuating said valve means in accordance with the configuration of said selected cam.

3. Horn signal apparatus for use on boats as recited in claim 2, said apparatus further comprising:

cam driver means driven by said speed-decreasing, torque-increasing transmission means, said cam driver means being coupled to said plurality of cams for simultaneously rotating said plurality of cams, said plurality of cams being movable relative to said cam driver means, and said manually-operable, mode-selection means being operatively associated with said plurality of cams for moving said cams relative to said cam driver means for bringing said cam-follower valve actuator means into engagement with a selected one of said cams.

4. Horn signal apparatus for use on boats as recited in claim 3, in which:

said plurality of cams includes nine cams each having a different cam configuration, and each respective cam configuration corresponds with a predetermined one of nine different marine horn-sounding signal sequences.

5. Horn signal apparatus for use on boats a recited in claim 3, in which:

said cam driver means comprises a rotatable shaft, said plurality of cams are keyed to said rotatable shaft for driving said plurality of cams with rotary motion, and said plurality of cams are slidable along said rotatable shaft by said manually-operable, mode-selection means.

6. Horn signal apparatus for use on boats as recited in claim 3, further comprising:

switch actuator means responsive to rotation of said cam driver means for rotating in response to rotation of said cam driver means, and said switch means being controlled by said switch actuator means for deenergizing said motor drive means after said cam driver means has been rotated a predetermined number of times.

7. Horn signal apparatus for use on boats as recited in claim 5, further comprising:

a switch actuator means coupled to said rotatable shaft for moving said switch actuator means in response to rotation of said rotatable shaft, and said switch means being controlled by said switch actuator means for deenergizing said motor drive means upon said rotatable shaft becoming rotated into a predetermined stopping position.

8. Horn signal apparatus for use on boats as recited in claim 2, further comprising:

said cam-follower valve actuator means including a lever and fulcrum means for controlling said lever, said fulcrum means having a first condition of operation in which said fulcrum means enables said lever to actuate said valve means and having a second condition of operation in which said fulcrum means disables said lever for preventing said lever from actuating said valve means, speed-reducing gear means driven by said transmission means for providing a rotational speed slower than the rotational speed of said plurality of cams, and said fulcrum means being controlled by said speed-reducing gear means and being placed in said first condition by said speed-reducing gear means for enabling said lever to actuate said valve means during at least one rotation of said plurality of cams and being placed in said second condition by said speed-reducing gear means for disabling said valve means for preventing said lever from actuating said valve means during at least one rotation of said plurality of cams.

9. Horn signal apparatus for use on boats as recited in claim 8, further comprising:

switch actuator means controlled by said speed-reducing gear means for controlling said switch means, and said switch means being controlled by said switch actuator means for deenergizing said motor drive means upon said fulcrum means having completed a cycle of operation including being placed in said first condition of operation and being placed in said second condition of operation.

10. Horn signal apparatus for use on boats as recited in claim 9, in which:

said speed-reducing gear means provides a speed reduction in the range from about 4 to 1 to about 15 to 1 relative to the rotation of said plurality of cams.

11. Horn signal apparatus for use on boats as recited in claim 9, in which:

said switch actuator means which is controlled by said speed-reducing gear means controls said fulcrum means for placing said fulcrum means in said first condition of operation and in said second condition of operation.

12. Horn signal apparatus for use on boats as recited in claim 11, wherein said switch actuator means further comprises:

latch means for latching said fulcrum means in said first condition of operation and for releasing said fulcrum means in said second condition of operation.

13. Horn signal apparatus for use on boats as recited in claim 8, in which:

said lever has first and second ends with an intermediate portion located between said first and second ends, said first end of said lever includes cam follower means engageable with a selected one of said cams, said intermediate portion of said lever is coupled to said valve means, said fulcrum means is positioned adjacent to said second end of said lever, said fulcrum means in said first condition of operation is operatively associated with said lever near said second end for providing a fulcrum for causing said lever to act as a lever of the second class for actuating said valve means in response to movement of said cam follower means by a selected cam, and said fulcrum means in said second condition of operation is out of operative association with said lever for preventing said lever from actuating said valve means.

14. Horn signal apparatus for use on boats, said apparatus comprising:

a horn, valve means connected between said horn and a removable container of pressurized gas for preventing pressurized gas from flowing from said container to said horn, said valve means being actuatable for allowing pressurized gas to flow from said container to said horn for sounding said horn, actuating means for actuating said valve means, said actuating means including a plurality of rotatable cams, each of said rotatable cams having a configuration corresponding to a respective horn-sounding signal for actuating said valve means for allowing pressurized gas to flow to said horn for sounding said horn corresponding to the respective horn-sounding signal, said respective horn-sounding signals being different one from another for relating to predetermined respective horn signals in accord with marine horn-signalling protocol, controllable electric motor drive means coupled to said plurality of cams for rotating said cams, and manually-operable, mode-selection means operatively associated with said plurality of cams for selecting any one of said cams for actuating said valve means in accordance with the configuration of said selected cam for sounding the respective horn-sounding signal.

15. Horn signal apparatus for use on boats as recited in claim 14, wherein said actuating means further comprises: cam-follower valve actuator means associated with said valve means for actuating said valve means, and said manually-operable, mode-selection means bringing said cam-follower valve actuator means into engagement with a selected one of said cams as desired by an operator of said apparatus for actuating said valve means in accordance with said selected cam for sounding the respective horn-sounding signal as desired by the operator.

16. Horn signal apparatus for use on boats as recited in claim 14, wherein said electric motor drive means further comprises speed-reducing torque-increasing transmission means for rotating said cams at a rotational rate in the range from about 2 revolutions per minute to about 10 revolutions per minute.

17. Horn signal apparatus for use on boats as recited in claim 16, wherein said speed-reducing, torque-increasing transmission means further comprises:

cam driver means coupled to said plurality of cams for simultaneously rotating said plurality of cams at said rotational rate, said plurality of cams being movable relative to said cam driver means, and said manually-operable, mode-selection means being operatively associated with said plurality of cams for moving said cams relative to said cam driver means for bringing said cam-follower valve actuator means into engagement with a selected one of said cams as desired by an operator of said apparatus.

18. Horn signal apparatus for use on boats as recited in claim 16, in which:

said plurality of cams includes nine cams each having a different cam configuration, and each respective cam configuration corresponds with a predetermined one of nine different marine horn-sounding signals.

19. Horn signal apparatus for use on boats as recited in claim 14, in which:

electric circuit means connected to said controllable electric motor drive means for controlling said electric motor drive, and a switch in said circuit means is associated with said manually-operable, mode-selection means for keeping said electric motor drive means running when at least one cam is selected for automatically repeatedly sounding the respective horn-sounding signal produced by said at least one cam.

20. Horn signal apparatus for use on boats, said apparatus comprising:

a horn, valve means connected between said horn and a removable container of pressurized gas for preventing pressurized gas from flowing from said container to said horn, said valve means being actuatable into an open condition for allowing pressurized gas to flow from said container to said horn for sounding said horn, actuating means for actuating said valve means, said actuating means including a plurality of cams, each of said cams having a different cam configuration, each cam configuration being capable of actuating said valve means for sounding said horn corresponding to a respective predetermined horn-sounding signal sequence, each respective predetermined horn-sounding signal sequence corresponding to a respective predetermined marine warning signal, controllable electric drive means for simultaneously rotating said plurality of cams, and manually-operable control means associated with said cams for selecting any one of said cams for actuating said valve means for sounding said horn to obtain the predetermined horn-sounding signal sequence produced by the selected cam.

21. Horn signal apparatus for use on boats as recited in claim 20, wherein said drive means further comprises:

first speed-reducing, torque-increasing transmission means coupled between said controllable electric drive means and said plurality of cams for simultaneously rotating said plurality of cams, electric circuit means for controlling said controllable electric drive means, a normally-open, manually-operable start switch in parallel with first and second switches in said electric circuit means, said controllable electric drive means running whenever any one of said start and first and second switches is closed, said first switch being operable by said drive means and being responsive to the rotational position of said plurality of cams and being opened when said plurality of cams are in an initial rotational position and said first switch being closed when said plurality of cams are rotated away from said initial position, switch-actuating means for controlling said second switch, second speed-reducing, torque-increasing transmission means driven by said controllable electric drive, means and being coupled to said switch-actuating means for rotating said switch-actuating means at a rotational rate no more than one-half of a rotational rate of said plurality of cams, said second switch being responsive to said switch-actuating means and being opened when said switch-actuating means is in an initial rotational position and being closed when said switch-actuating means is away from said initial position for running said controllable electric drive means to produce a plurality of rotations of said plurality of cams upon manual actuation of said start switch.

22. Horn signal apparatus for use on boats as recited in claim 21, further comprising:

cam-following valve actuator means coupled to said valve means for actuating said valve means in response to a cam selected by said manually-operable control means, and said switch-actuating means controlling said valve actuator means for actuating said valve means for sounding said horn during only one of said plurality of rotations of said plurality of cams.

* * * * *